US005366670A

United States Patent [19]

Giner et al.

[11] Patent Number: 5,366,670

[45] Date of Patent: Nov. 22, 1994

[54] METHOD OF IMPARTING CORROSION RESISTANCE TO REINFORCING STEEL IN CONCRETE STRUCTURES

[75] Inventors: Jose D. Giner, Brookline; Nancy D. Kackley, Cambridge, both of Mass.

[73] Assignee: Giner, Inc., Waltham, Mass.

[21] Appl. No.: 32,504

[22] Filed: May 20, 1993

[51] Int. Cl.[5] ..... C23F 13/00; E04B 1/16

[52] U.S. Cl. ..... 264/22; 204/147; 204/196; 264/35

[58] Field of Search ..... 264/27, 22, 333, 35; 204/147, 196

[56] References Cited

U.S. PATENT DOCUMENTS

| | | | |
|---|---|---|---|
| 2,683,916 | 7/1954 | Kelly . | |
| 4,255,241 | 3/1981 | Kroon et al. | 204/147 |
| 4,699,703 | 10/1987 | Norman | 204/196 |
| 4,812,212 | 3/1989 | Dimond et al. . | |
| 4,832,803 | 5/1989 | Vennesland et al. . | |
| 4,874,487 | 10/1989 | Reed et al. | 204/147 |
| 4,894,135 | 1/1990 | Farque | 204/147 |
| 4,900,410 | 2/1990 | Bennett et al. | 204/147 |
| 4,931,156 | 6/1990 | Dowd et al. | 204/147 |
| 4,990,231 | 2/1991 | Stewart et al. | 204/147 |
| 5,031,290 | 7/1991 | Brereton et al. | 204/147 |
| 5,062,934 | 11/1991 | Mussinellil | 204/147 |
| 5,071,579 | 12/1991 | Johnston et al. | 106/14.12 |
| 5,127,954 | 7/1992 | Johnston et al. | 106/644 |
| 5,141,607 | 8/1992 | Swiat | 204/147 |
| 5,183,694 | 2/1993 | Webb | 204/147 |
| 5,198,082 | 3/1993 | Vennesland et al. | 204/147 |
| 5,225,058 | 7/1993 | Bazzoni et al. | 204/147 |

FOREIGN PATENT DOCUMENTS

| | | | |
|---|---|---|---|
| 262605 | 12/1985 | Japan . | |
| 676627 | 7/1952 | United Kingdom . | |
| 2140456 | 11/1984 | United Kingdom . | |
| 2186017 | 8/1987 | United Kingdom . | |
| 312840 | 11/1971 | U.S.S.R. | 264/27 |
| 353921 | 11/1972 | U.S.S.R. | 264/27 |
| 87/06521 | 11/1987 | WIPO . | |

*Primary Examiner*—Karen Aftergut
*Attorney, Agent, or Firm*—Hale and Dorr

[57] ABSTRACT

A method of in situ protection against corrosion of steel reinforcing bars in freshly poured concrete by application of a potential (anodic or cathodic), thereby enhancing the corrosion resistance of the steel for the life of the reinforced concrete structure.

11 Claims, 2 Drawing Sheets

METHOD OF IMPARTING CORROSION RESISTANCE TO REINFORCING STEEL IN CONCRETE STRUCTURES

FIELD OF INVENTION

This invention is directed at improvement of steel reinforcing bars (rebars) embedded in concrete structures, such as bridge decks, parking garage decks, pillars in maritime structures, etc., by an electrochemical treatment during the concrete pouring step. More specifically, the invention is directed at a method to protect steel bars against corrosion during the construction of reinforced concrete structures by application of an electric potential to the rebar during the initial concrete curing period.

BACKGROUND OF THE INVENTION

The corrosion of the rebar in steel-reinforced concrete structures is a phenomenon of considerable economic importance. J. Tinnea in Materials Performance, 26 (12), 9 (1987), reported that 243,000 bridges under FHWA monitoring were judged to be structurally deficient and in need of repair. In 1986, the Transportation Research Board (TRB) estimated that $20 billion was required to rehabilitate and repair corrosion-induced damage on existing bridge decks nationwide. The repair cost was estimated to be increasing by $500 million annually. In a 1991 report by the Secretary of Transportation to the U.S. Congress on the status of the nation's highways and bridges, the backlog of needed bridge repairs due to structural deficiencies as of the end of 1989 was estimated at $55 to $68 billion. The annual average investment needed for 1990 to 2009 to simply maintain the current structural condition of the nation's bridges was estimated at $2 to $3 billion. To improve conditions and reduce structural deficiencies, an annual average investment of $3 to $6 billion would be needed. The report estimated that 7,000 bridges require rehabilitation or replacement each year.

Concrete is typically a very benign environment for steel because of its mildly alkaline nature. In addition, the concrete layer represents a barrier to external agents which promote corrosion such as oxygen and chloride ions, either during fabrication, or by diffusion from the surroundings. However, when chloride is introduced into concrete, the natural passivity of steel in this environment can be severely compromised. Chloride promotes pitting corrosion, leading to destructive corrosion of the steel, and formation of voluminous, non-adherent iron oxides (rust) which as described below can lead to loss of strength and cracking of the concrete. Chloride is commonly introduced to reinforced concrete through the use of deicing salts or chloride-containing admixtures or by exposure to marine atmospheres.

The damage to reinforced concrete structures is caused principally by permeation of the chloride ions through the concrete to the area surrounding the steel rebar. Because the corrosion products are more voluminous than the base metal, pressure is exerted on the concrete from within, leading to cracking and spalling of the concrete. The corrosion also reduces the effective cross-section and, therefore, the strength of the rebar.

Many different techniques are used in attempts to reduce the corrosion of rebar in concrete, including epoxycoated or galvanized rebar, special low-water concrete mixtures, corrosion inhibitors mixed into the concrete and sealants spread on the finished concrete. Each of these methods requires either additional materials and/or labor costs or long-term capital equipment and maintenance costs, or some compromise in the properties of the concrete (e.g., setting time, ease of pouring, viscosity). Epoxy-coated rebars, special concrete mixtures or inhibitors require that special procedures be followed during construction in order to achieve the optimum benefit of the technique.

A primary object of the present invention is to provide a new and improved method to make concrete-embedded steel reinforcing bars resistant to corrosion during the life of the reinforced concrete structure.

A further object of the present invention is to provide conditions under which the treatment of steel reinforcing bars in wet concrete, cement or mortar can be carried out so as to make the steel surface resistant to corrosion attack.

A still further object is to provide a method for making steel reinforcing bars, embedded in concrete, corrosion resistant, which is inexpensive, safe and requires no long-term maintenance, labor or materials costs.

SUMMARY OF THE INVENTION

The objects of the invention can be realized by taking advantage of the very high ionic conductivity of freshly poured concrete, i.e., during the first six or seven hours after pouring, to apply an electric potential to the rebar, which results in a current flow through the rebar-fresh concrete interface which improves the nature of the rebar-concrete interface against subsequent corrosion. The beneficial modification of the rebar-concrete interface can take place by applying to the rebar anodic, cathodic or a combination of anodic and cathodic pulses. As used herein, the word "pulse" is meant to indicate a temporary flow of current through the rebar-fresh concrete interface or the application to the rebar of a temporary electrical potential which results in current flow.

A protective iron oxide film on the surface of the steel reinforcing bar is created by the application of a potential pulse between the rebar, which is embedded in the wet, freshly poured concrete, and an externally situated counter electrode which results in an anodic current flow at the rebar. The creation of a uniform, dense and strongly adherent iron oxide film on the rebar surface will impart corrosion resistance to the rebar by resisting the action of aggressive chemical species such as chloride ions.

Application of anodic or cathodic pulses during the initial part of the curing period promotes, by electrophoretic effect, a tight, protective layer of concrete components on the rebar surface.

These and other objects of the invention will be apparent from the following detailed description which should be read in light of the accompanying drawings in which corresponding reference numerals represent corresponding parts throughout the views.

DETAILED DESCRIPTION OF THE PREFERRED EMBODIMENTS

Figure 1:
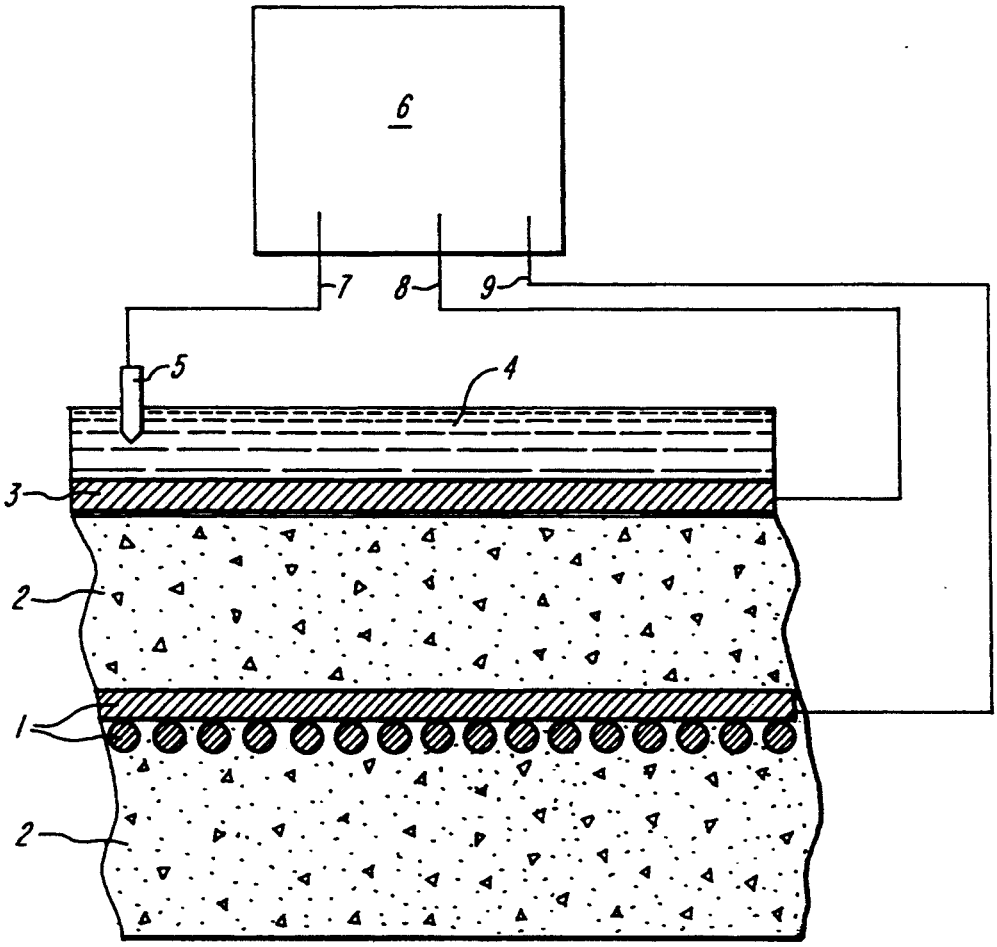
FIG. 1 is a diagram of the equipment necessary for carrying out the method of the present invention utilizing a three-electrode system.

One preferred embodiment of the present invention is shown in FIG. 1, which is a diagram of the equipment arrangement for the passivation treatment method. As illustrated in FIG. 1, a three-electrode electrode potential-controlled power supply (potentiostat) 6 is connected to the rebar mat 1, an externally situated counter electrode 3, and a reference electrode 5, via the working electrode Y, counter electrode 8 and reference electrode 9 jacks of the device. The rebar mat 1 is embedded in wet, freshly poured concrete 2, which term for purposes of this application includes cement and mortar. The counter electrode 3 is a metal screen, preferably stainless steel, placed on top of the wet concrete and covered with a thin layer of water 4 to insure electrical continuity between the three electrodes. A reference electrode 5, such as copper/copper sulfate, is placed in ionic contact with the water layer 4. The potentiostat 6 is adjusted to maintain a specific, constant voltage difference between the rebar mat 1 and the reference electrode 5.

Figure 2:
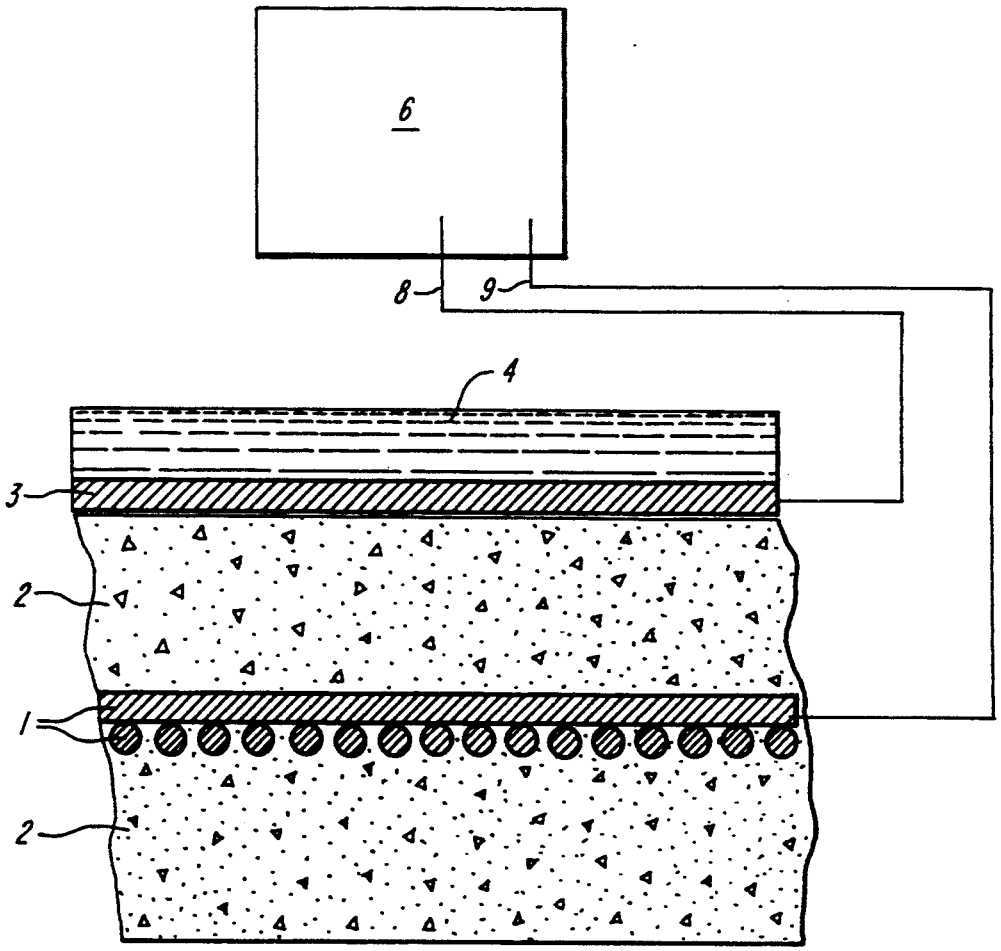
FIG. 2 is a block diagram of an alternate embodiment of the equipment for carrying out the method of the present invention which utilizes a two-electrode system.

Another preferred embodiment of the invention is shown in FIG. 2. This figure shows a diagram of the passivation treatment method utilizing a two-electrode system. In other respects, the system is similar to that shown in FIG. 1, with a rebar mat 1, embedded in wet, freshly poured concrete 2 with a counter electrode 3 placed on top of the wet concrete in a thin layer of water 4. A power supply 6 is used to apply the voltage difference between the rebar mat 1 and the counter electrode 3.

The rebar mat must be welded or mechanically joined together so that the entire rebar structure is electrically continuous. The counter electrode may be a metal screen or mat, either flexible or composed of easily transportable sections that can be conveniently joined together to make an electrically continuous sheet. The counter electrode must be made of a corrosion-resistant metal such as stainless steel, titanium, nickel-plated steel or other metal which will not be attacked by the alkalinity of wet concrete. The electrochemical treatment of the rebar must be carried out during the first six to seven hours of curing, or during such time when the concrete conductivity is relatively high compared to the cured, hardened state. Conductivity of 1 ohm-$m^{-1}$ or greater is sufficient for typical Type I concretes. For the anodic passivation of the rebar the electrical potential applied to the rebar mat should be between 0.37 V and −0.08 V vs. the Cu/$CuSO_4$ reference electrode, after correction for solution and interface resistances, or such potential as will cause a current of 0.1 to 10 mA/$cm^2$ (which decays with time) to flow between the rebar mat and the counter electrode.

As mentioned above pulses applied to the rebar may be anodic, cathodic or a combination of anodic and cathodic pulses. By applying anodic or cathodic pulses during the initial part of the curing period, a tight, protective layer of concrete components on the rebar surface is promoted by electrophoretic effect. The application of complex electric pulses with both anodic and cathodic components during the curing process is also effective in protecting the rebar against corrosion. For instance, the application of a cathodic-anodic bipulse causes, first, the reduction of ill-defined, unprotective oxides followed by the formation of the protective passive film. An alternating electric wave can also be used. In a simple case, it can be a sinusoidal wave of potential or current with a d.c. component. By selection of frequency, intensity and d.c. bias, it is possible to obtain relatively thick and compact oxide layers with improved protective characteristics.

The electrochemical treatment can be applied concurrently with other corrosion-preventative measures such as inhibitors (e.g., calcium nitrite), or with epoxy-coated rebars or with additives to the concrete admixture which by electrophoresis form a protective layer on the rebar. In the first case, the treatment prolongs the effectiveness of the nitrite inhibitor. In the second case, the treatment serves to reduce the negative impact of imperfections and fractures in the coating.

The following non-limiting examples will further highlight the advantages of the present invention.

EXAMPLE 1

Two pieces of Grade 60 rebar were placed into saturated $Ca(OH)_2$ solution. This solution simulates the pore solution found in concrete. In order to greatly accelerate the test, both samples were cathodically pretreated at −1.1 V (vs. Hg/HgO/KOH reference electrodes) for 15 minutes. One piece of rebar was passivated at 0.25 V (vs. Hg/HgO reference electrode) for 1 hour. Subsequently, NaCl was added to both saturated $Ca(OH)_2$ solutions to a 0.05M level. The current density from the test rebars, treated and untreated to a steel counter electrode was measured at a predetermined open-circuit potential (−0.03 V for the treated rebar; 0.02 V for the untreated rebar). After 20-hours exposure, the current density measured on the treated rebar was approximately half that measured on the untreated rebar, 0.75 mA/$cm^2$ vs. 1.55 mA/$cm^2$. This lower current level resulted directly in 66% less corrosion on the rebar, even under these greatly accelerated and severe conditions.

EXAMPLE 2

Two pieces of Grade 60 rebar were placed into saturated $Ca(OH)_2$ solution. In order to greatly accelerate the test, both samples were cathodically pretreated at −1.1 V (vs. Ha/HgO) for 15 minutes. One piece of rebar was passivated at 0.25 V for 30 minutes. Subsequently, NaCl was added to both saturated $Ca(OH)_2$ solutions to a 0.005M level. The open-circuit potential of both rebars was monitored vs. the Hg/HgO reference electrode for 16 hours. After 10-hours exposure, treated rebar showed an open-circuit potential 0.11 V more positive than the untreated rebar; −0.13 V vs. −0.24 V. According to *ASTM Standard Test Method* C876 *for Half-Cell Potentials of Uncoated Reinforcing Steel in Concrete*, rebar potentials more negative than −0.23 V (vs. Hg/HgO) indicate a greater than 90% probability of corrosion. It is an accepted criterion of the reinforced concrete industry that more positive potentials indicate that less corrosion is occurring.

EXAMPLE 3

Two pieces of rebar were embedded in cement mortar containing 55% sand, 30% cement and 15% water with a cover depth of cement over the rebar of 1 cm. One piece of rebar was passivated while embedded in the wet cement at 0.25 V for 6 hours. The other piece of rebar was not passivated. The cement-rebar samples were allowed to cure for 28 days, then were exposed to 0.05M NaCl solution for 21 days. After this exposure, the rebar samples were broken out of the cement. The passivation treatments in the cement caused the formation of a white film and very adherent cementitious deposits on the rebar surface. This is due to the electrophoretic phenomenon and indicates the formation of a stronger bond between the rebar and the cement due to the passivation treatment.

While the foregoing invention has been described with reference to its preferred embodiments, various alterations and modifications will occur to those skilled in the art. All such alterations and modifications are intended to fall within the scope of the appended claims.

What is claimed is:

1. A method for improving corrosion resistance of steel reinforcing bars embedded in concrete, said method comprising the steps of:

embedding said steel reinforcing bars in wet freshly poured concrete having a high ionic conductivity;

positioning a counter electrode a distance from said embedded steel reinforcing bars;

applying and maintaining a specific, constant voltage difference between said steel reinforcing bars and said counter electrode while said steel reinforcing bars are embedded in said wet freshly poured concrete to take advantage of said high ionic conductivity of said wet freshly poured concrete at an interface between said steel reinforcing bars and said freshly poured concrete to thereby improve said corrosion resistance of said steel reinforcing bars by creating a protective iron oxide film on said steel reinforcing bars.

2. The method for improving the corrosion resistance of steel reinforcing bars of claim 1 wherein said steel reinforcing bars are arranged in a mat.

3. The method for improving the corrosion resistance of steel reinforcing bars of claim 1 wherein said counter electrode is placed on an outer surface of said wet freshly poured concrete.

4. The method for improving the corrosion resistance of steel reinforcing bars of claim 3 wherein said counter electrode is covered with a thin layer of water.

5. The method for improving the corrosion resistance of steel reinforcing bars of claim 1 wherein said counter electrode is a metal screen.

6. The method for improving the corrosion resistance of steel reinforcing bars of claim 1 further comprising the steps of positioning a reference electrode in ionic contact with said counter electrode and said steel reinforcing bars.

7. The method for improving the corrosion resistance of steel reinforcing bars of claim 1 wherein said step of applying and maintaining a specific and constant voltage difference comprises attaching a potentiostat to said counter electrode and said steel reinforcing bars and adjusting said potentiostat to apply and maintain said voltage difference.

8. The method for improving the corrosion resistance of steel reinforcing bars of claim 6 wherein said reference electrode is a $Cu/CuSO_4$ electrode and wherein voltage applied to said steel reinforcing bars is between 0.37 V and −0.08 V compared to said $Cu/CuSO_4$ electrode.

9. The method for improving the corrosion resistance of steel reinforcing bars of claim 1 wherein said step of applying and maintaining a specific, constant voltage difference comprises applying anodic pulses to said steel reinforcing bars.

10. The method for improving the corrosion resistance of steel reinforcing bars of claim 1 wherein said step of applying and maintaining a specific, constant voltage difference comprises applying cathodic pulses to said steel reinforcing bars.

11. The method for improving the corrosion resistance of steel reinforcing bars of claim 1 wherein said step of applying and maintaining a specific, constant voltage difference comprises applying anodic and cathodic pulses to said steel reinforcing bars.

* * * * *